US005931624A

United States Patent [19]

Naruse

[11] Patent Number: 5,931,624

[45] Date of Patent: Aug. 3, 1999

[54] PAPER PROCESSING APPARATUS

[75] Inventor: Akira Naruse, Toyokawa, Japan

[73] Assignee: Minolta Co., Ltd., Osaka, Japan

[21] Appl. No.: 08/970,381

[22] Filed: Nov. 14, 1997

[30] Foreign Application Priority Data

Nov. 20, 1996 [JP] Japan ..... 8-309153

[51] Int. Cl.[6] ..... B42C 1/12; B42C 1/10

[52] U.S. Cl. ..... 412/84; 412/84; 412/37; 412/41; 412/900; 412/902

[58] Field of Search ..... 412/4, 8, 37, 41, 412/900, 902

[56] References Cited

U.S. PATENT DOCUMENTS 5,240,362 8/1993 Nakayama et al. .

5,570,985 11/1996 Latvakangas et al. ..... 412/4

*Primary Examiner*—Willmon Fridie, Jr.
*Assistant Examiner*—Mark T. Henderson
*Attorney, Agent, or Firm*—McDermott, Will & Emery

[57] ABSTRACT

A paper processing apparatus that can efficiently bind a cover and a set of sheets and does not reduce the productivity of the copying process in the previous step.

The paper processing apparatus includes a binding unit, a packet collating chamber and conveyance rollers. The rotational shaft of a conveyance roller has a spiral-shaped blade member that encircles said rotational shaft and has a heater inside. The packet is supplied from the packet collating chamber to the binding unit where it is carried in a particular direction as the conveyance rollers rotate. During this conveyance, the adhesive substance that is applied to the cover in advance melts and the packet becomes bound.

9 Claims, 4 Drawing Sheets

PAPER PROCESSING APPARATUS

BACKGROUND OF THE INVENTION

1. Field of the Invention

The present invention pertains to a paper processing apparatus, and more particularly to a paper processing apparatus having a binding function to insert paper that is ejected from an image forming apparatus such as an electrophotographic copying machine or laser printer into a cover that has been folded in two and to bind them together.

2. Related Art of the Invention

In recent years, in the field of copying machines and laser printers, various paper processing apparatuses (also termed finishers) having functions to perform such things as stapling or hole punching of sheets on which an image has been formed, or binding in which copy sheets are inserted into a cover that has been folded in two, have been proposed.

Conventionally, a binding function is known in which, inside a collating chamber, multiple copy sheets are inserted into a cover that has been folded into two and has an adhesive substance applied along the inner fold, and bonding of cover and the copy sheets is performed by applying heat to the adhesive substance using a heater. When bonding is completed, the bound material is ejected from the collating chamber. However, using this type of device, because the heat bonding and packet binding processes are performed in the collating chamber for one set of cover and copy sheets at a time, the processing time inside the collating chamber is longer than the time necessary for copying, and as a result the copying process is forced to wait, thereby reducing productivity.

OBJECT AND SUMMARY

Consequently, the object of the present invention is to provide a paper processing apparatus equipped with a binding function that can efficiently perform heat processing without a reduction in the productivity of the copying or printing process used in the previous step.

In order to attain the object described above, the paper processing apparatus of the present invention comprises a collating chamber to insert multiple sheets into a cover that has been folded in two and has an adhesive substance applied along the inner fold, a supplying means that supplies a cover into the collating chamber, a supplying means that supplies sheets to the collating chamber, a conveying means that comprises spiral-shaped blade members encircling rotational shafts and heaters located inside the rotational shafts so that it receives the collated packets from the collating chamber and melts said adhesive substance while conveying the packets in a particular direction, and an ejecting means that ejects from the conveying means the packets conveyed by the conveying means.

In the construction described above, after the cover and sheets are collated in the collating chamber, they are immediately sent to the conveying means, whereupon they are grasped by the spiral-shaped blade members and conveyed in a particular direction along the rotational shafts. During this conveyance, heat from the heaters is applied via the rotational shafts, the adhesive substance is melted, and the adhesion process is completed.

Using the present invention, because the heating process is performed while the conveying means is conveying the packets, there is no need for the cover and the sheets to wait before being supplied to the collating chamber and the copying or printing process that takes place in the previous step can be performed at normal speed. Consequently, there is no reduction in productivity. Moreover, heating may be performed to multiple packets while they are being sequentially conveyed by the conveying means. Therefore, the efficiency of the binding process is promoted by this feature as well.

DETAILED DESCRIPTION OF THE EMBODIMENT

The embodiment of the paper processing apparatus pertaining to the present invention will be explained below with reference to the attached drawings.

Figure 1:
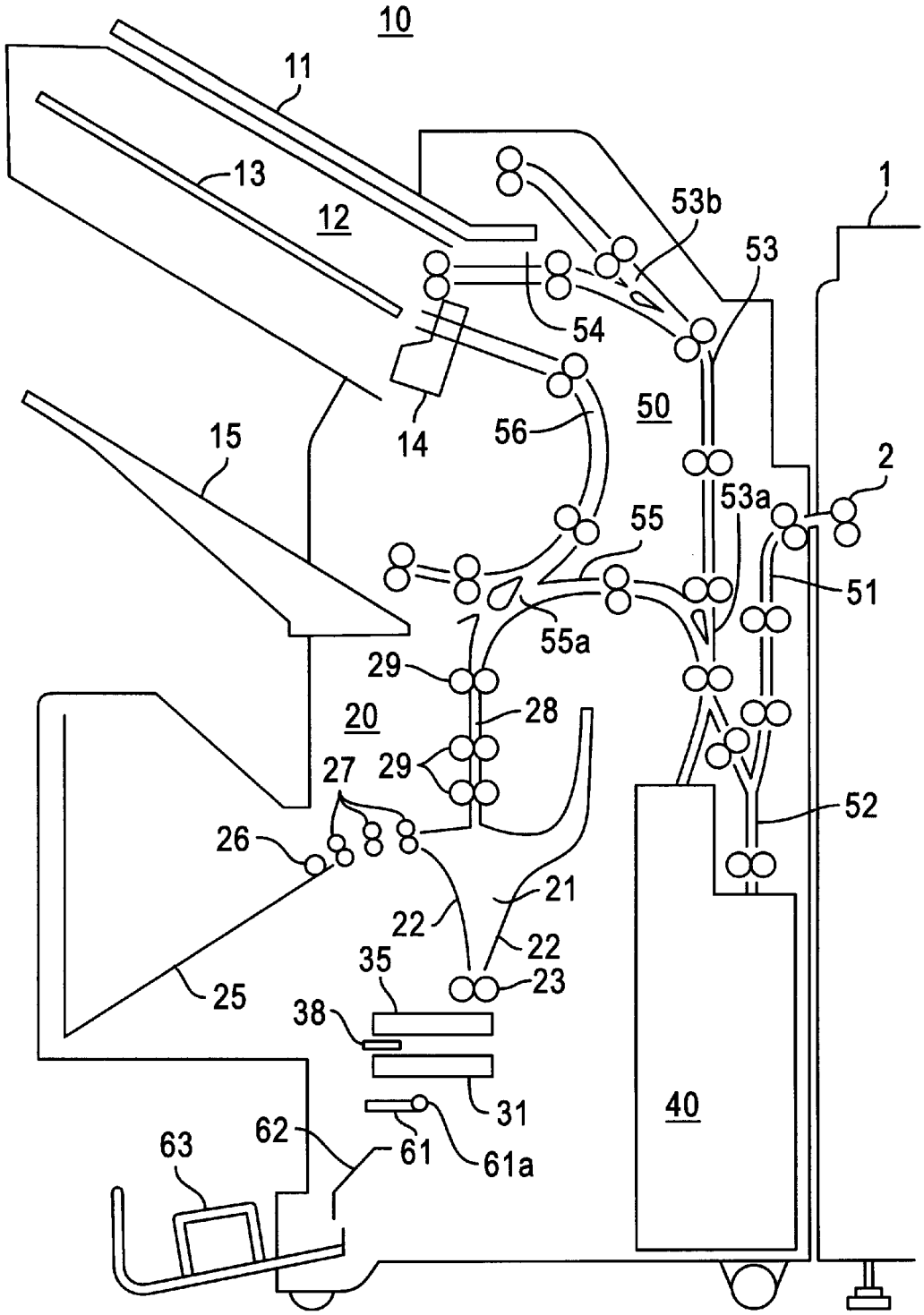
FIG. 1 is a drawing showing the outline construction of the paper processing apparatus pertaining to one embodiment of the present invention.

In FIG. 1, paper processing apparatus 10 stacks, staples and binds the copy sheets that are ejected from copying machine 1, and performs other processing as necessary, such as folding. Copying machine 1 forms images on paper using the publicly known electrophotographic method, and ejects copy sheets from pair of ejection rollers 2.

Paper processing apparatus 10 comprises non-sorting tray 11 that stacks and holds the copy sheets ejected from copying machine 1, stapling unit 12 that staples together the copy sheets by means of stapler 14 after they are stacked on tray 13, vertically movable large-capacity paper holding tray 15, binding unit 20, paper folding unit 40 and copy sheet conveying unit 50.

Copy sheet conveying unit 50 comprises conveyance path 51 that receives the sheets ejected from copying machine 1 and carries them downward, switch back conveyance path 52 that reverses the direction of the sheets and carries them upward, conveyance path 53 that carries the switched-back sheets to non sort tray 11, conveyance path 54 that carries the sheets from separating point 53*b* of conveyance path 53 to stapling unit 12, conveyance path 55 that carries the sheets from separating point 53*a* of conveyance path 53 to large-capacity paper holding tray 15, and conveyance path 56 that carries the packets stapled by stapling unit 12 to merging point 55*a* of conveyance path 55.

The construction and operation of said stapling unit 12, large-capacity paper holding tray 15 and paper folding unit 40, as well as the construction and operation of conveying unit 50, are identical to those of the conventional designs. Therefore, their explanations will be omitted.

Figure 2:
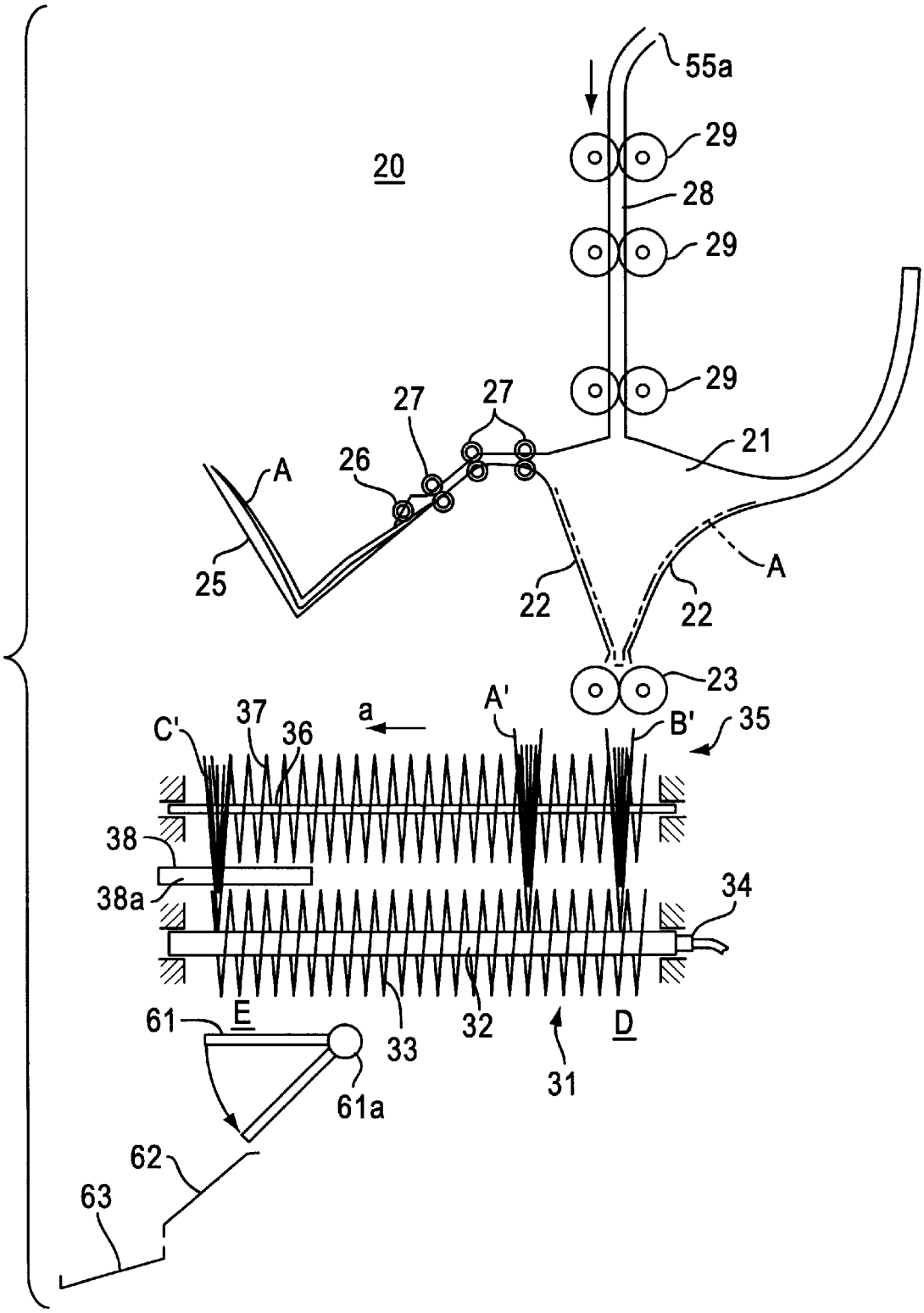
FIG. 2 is a side elevation of a binding unit.
Figure 3:
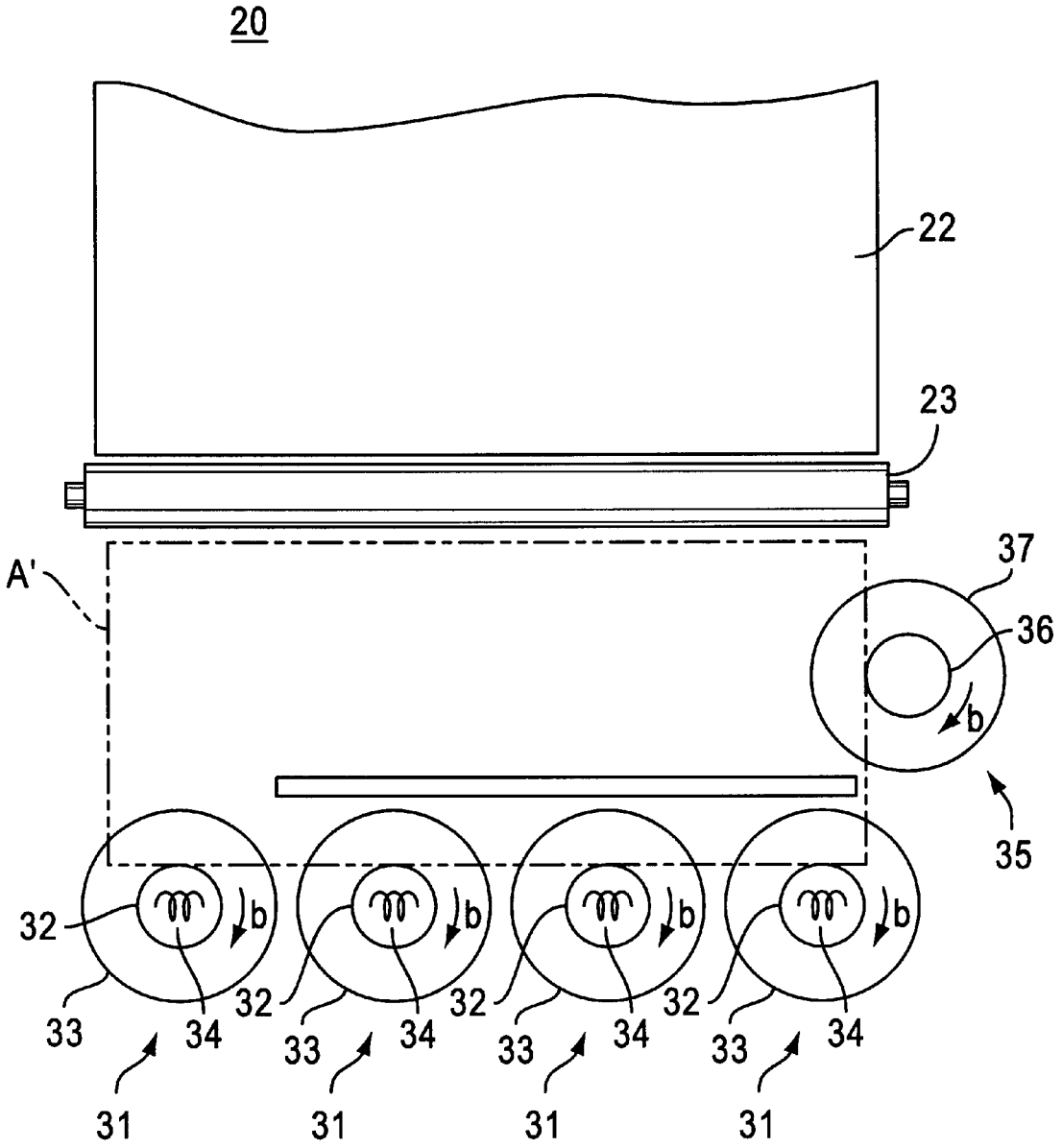
FIG. 3 is a front elevation of a binding unit.

Binding unit 20 essentially comprises, as shown in FIGS. 2 and 3, collating chamber 21, tray 25 that holds covers A in reserve, conveyance rollers 31 and 35 that heat cover A and a set of sheets (hereinafter jointly referred to as "packets A', B' and C'", and said packets A', B' and C' are explained below) while conveying them, and ejection plate 38.

Collating chamber 21 comprises guide plates 22 that face each other and are tilted relative to each other and pair of sending rollers 23 that are located at the lower ends of said guide plates. Above collating chamber 21 is located copy paper supply path 28 which is connected to said merging point 55*a*. Covers A that have a crease in the center are held in tray 25 in reserve. Covers A are supplied to collating chamber 21 one by one by means of supply roller 26 and pair of supply rollers 27. Cover A that has been supplied to collating chamber 21 is guided by guide plates 22 so that it is held in said chamber such that it is open and facing upward. Cover A has a hot-melt type adhesive substance applied in advance along its inner fold. The set of sheets to be bound is stapled by stapling unit 12 and supplied to collating chamber 21 via conveyance path 56 by means of pair of rollers 29 of supply path 28. Cover A and the set of sheets are combined in collating chamber 21.

It is also acceptable if the set of sheets is sent into collating chamber 21 without being stapled, i.e., via conveyance path 55 and supply path 28 on a sheet-by-sheet basis. An adhesive substance may be applied to cover A in collating chamber 21.

Figure 4:
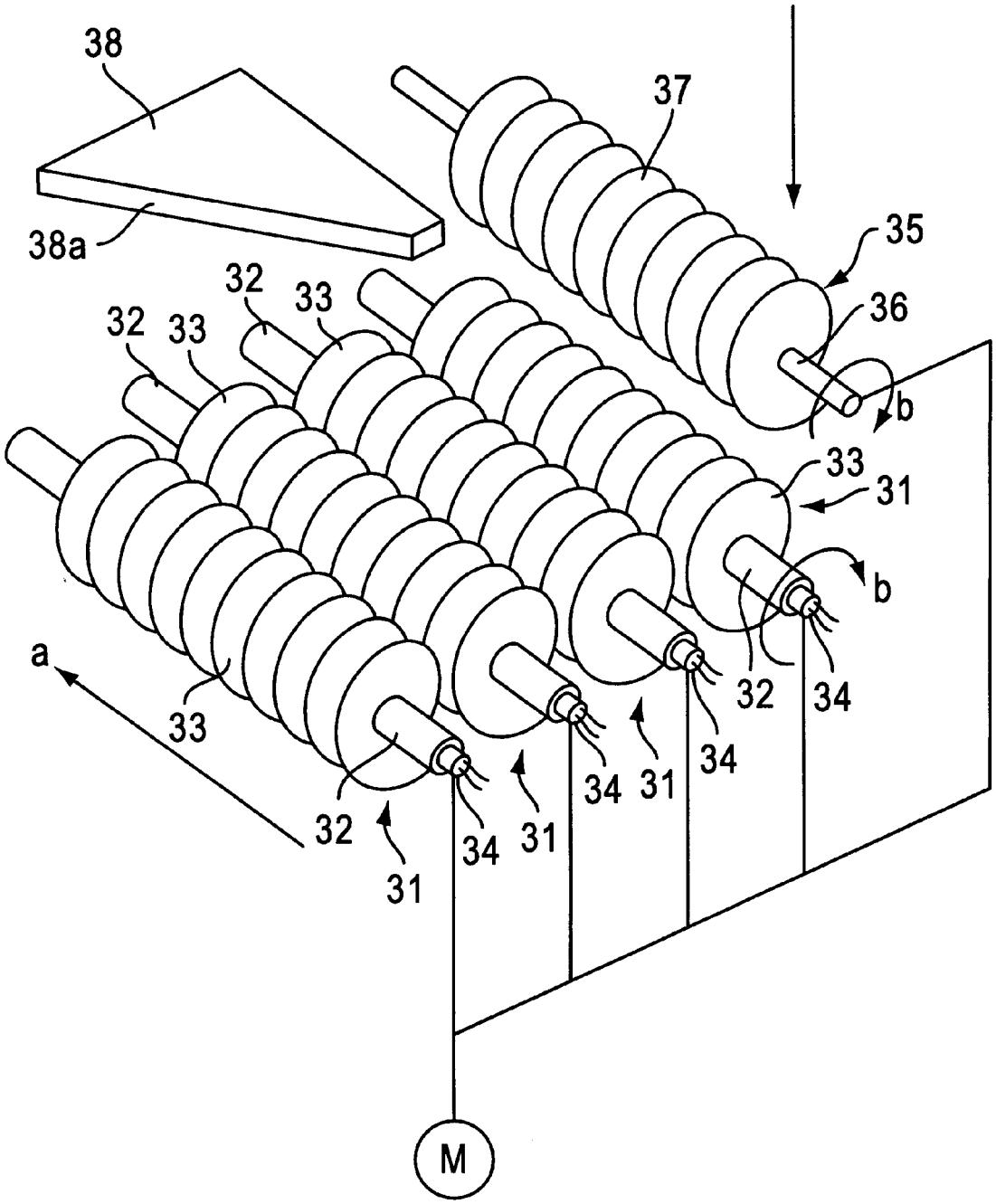
FIG. 4 is a perspective view showing conveyance rollers in the binding unit.

Conveyance rollers 31 each comprise, as shown in FIG. 4, spiral-shaped blade member 33 that encircles rotational shaft 32, and rod-style heater 34 inside rotational shaft 32. There are four rollers 31 placed parallel to one another. Conveyance roller 35 comprises spiral-shaped blade member 37 that encircles rotational shaft 36, and is located above conveyance roller 31 at the far right in FIG. 4 at a certain distance. These rollers 31 and 35 are driven to rotate in the direction indicated by arrow b at the same peripheral speed and in synchronization.

As shown in FIG. 2, the packet collated in collating chamber 21 is carried downward from collating chamber 21 by means of pair of sending rollers 23 and is conveyed on conveyance rollers 31 and 35 from point D to point E (in the direction indicated by arrow a with regard to conveyance rollers 31 and 35) in the drawing. Packet A' in the drawing is shown in a situation in which its fold is placed on rotational shafts 32 of conveyance rollers 31 and one side of it is held by blade member 37 of conveyance roller 35. Heaters 34 are already supplied with electric current and conveyance rollers 31 and 35 are driven to rotate in the direction indicated by arrow b. Consequently, packet A' is conveyed in the direction indicated by arrow a by means of spiral-shaped blade members 33 and 37, and at the same time, the adhesive substance is melted by the heating action of heaters 34, whereupon cover A and the set of sheets are bonded together.

Ejection plate 38 is located at the end of conveyance direction a and has guide surface 38*a* which is angled relative to conveyance direction a. Ejection fan 61 is located at the end of and under conveyance rollers 31 such that it can move up and down. Guide plate 62 and holding basket 63 are located farther on.

As described above, packet A' is bonded together while it is conveyed on conveyance rollers 31 in the direction indicated by arrow a. When it is conveyed up to the position of packet C' in the drawing, it is guided by guide surface 38*a* of ejection plate 38, or pushed out, so to speak, and is dropped onto ejection fan 61. Ejection fan 61 then moves up and down with support shaft 61*a* working as the fulcrum, and packet A' is carried into holding basket 63 via guide plate 62.

In this embodiment, packet A' is bound by being heated while being conveyed by conveyance rollers 31 and 35, and moreover, conveyance rollers 31 and 35 can continuously convey multiple packets A'. Consequently, covers A and sets of sheets may be sequentially supplied to collating chamber 21 without having to wait and therefore efficient bookbinding may be performed without a reduction in the copying productivity of copying machine 1.

In other words, in FIG. 2, where a first packet has been conveyed to the position of packet A' but has not reached the position of packet C', another packet is placed at the position of packet B' on conveyance rollers 31 and 35 via the rotation of pair of rollers 23. Due to the rotation of conveyance rollers 31 and 35, packet B' is also carried in the direction indicated by arrow a in the drawing.

The paper processing apparatus of the present invention is not limited to this embodiment, but may naturally be varied within the scope of the invention.

What is claimed is:

1. A paper processing apparatus comprising:

a collating chamber;

a first supplying device that supplies to the collating chamber a cover that has been folded in two and has an adhesive substance applied along the folded cover's inner fold;

a second supplying device that supplies a sheet to the collating chamber, so that an edge of the supplied sheet is positioned along the inner fold of the folded cover to make a packet; and a conveying device that conveys the packet from the collating chamber to an ejected portion and melts the adhesive substance while conveying the packet in a conveying direction to the ejection portion, wherein said conveying device comprises spiral-shaped blade members encircling rotational shafts and heaters located inside the rotational shafts to melt the adhesive substance.

2. The paper processing apparatus of claim 1, wherein said ejection portion further comprises an ejecting device that ejects from the conveying device the packet conveyed by the conveying device.

3. The paper processing apparatus of claim 1, wherein the conveying device conveys a plurality of packets at once.

4. A paper processing apparatus comprising:

a collating device forming a packet including a plurality of sheets;

a conveying device conveying the formed packet from the collating device to a discharging portion; and a binding device binding the packet while the packet is being conveyed to the discharging portion, wherein the collating, conveying and binding devices can perform their respective functions sequentially to continuously form and discharge multiple bound packets, and wherein said conveying device comprises spiral-shaped blade members encircling rotational shafts and heaters located inside the rotational shafts to melt the adhesive substance.

5. The paper processing apparatus of claim 4, wherein the collating device comprises:

a first supplying device that supplies to a collating chamber a cover that has been folded in two and has an adhesive substance applied along the folded cover's inner fold; and a second supplying device that supplies the sheets to the collating chamber, so that an edge of the supplied sheet is positioned along the inner fold of the folded cover to make the packets.

6. A paper processing apparatus comprising:

a first tray on which a cover having an adhesive substance applied thereto is provided;

a setting device for setting a sheet in contact with the adhesive substance of the cover to make a packet;

a second tray;

a conveying device for conveying the set packet from the first tray to the second tray, said conveying device comprising spiral-shaped blade members encircling rotational shafts and heaters located inside the rotational shafts to melt the adhesive substance; and a binding device for binding the cover to the sheet while the packet is conveyed by the conveying device.

7. A paper processing method comprising:

a first supplying step that supplies a cover, which has been folded in two and has an adhesive substance applied along the folded cover's inner fold, to a collating chamber;

a second supplying step that supplies a sheet to the collating chamber, so that an edge of the supplied sheet is positioned along the inner fold of the folded cover to make a packet; and a conveying step that conveys the packet with spiral-shaped blade members encircling rotational shafts from the collating chamber to an ejected portion and melts the adhesive substance with heaters located inside the rotational shafts to melt the adhesive substance while conveying the packet in a conveying direction to the ejected portion.

8. A paper processing method comprising:

a providing step that provides a packet including a plurality of sheets;

a conveying step that conveys the formed packet with spiral-shaped blade members encircling rotational shafts from a collating portion to a discharging portion; and a binding step that binds the sheet with the cover of packet while conveying the packet in conveying direction to the discharging portion.

9. A paper processing method comprising:

a providing step that provides a cover having an adhesive substance applied to a portion of the cover;

a setting step that sets a sheet in contact with the adhesive substance of the cover to make a packet;

a conveying step that conveys the packet with spiral-shaped blade members encircling rotational shafts to a tray; and a binding step that binds the cover with the sheet while the packet is conveyed by the conveying step to said tray.

* * * * *